US010287862B2

(12) United States Patent
Brewer et al.

(10) Patent No.: US 10,287,862 B2
(45) **Date of Patent: *May 14, 2019**

(54) STUFFING BOX LEAK CONTAINMENT APPARATUS

(71) Applicant: ANTI-POLLUTION TECHNOLOGY, L.P., Frisco, TX (US)

(72) Inventors: Jack G. Brewer, Chickasha, OK (US); Steven L. Shroyer, Redondo Beach, CA (US); Darrel B. Fruit, Oklahoma City, OK (US); Christopher Joe White, Oklahoma City, OK (US); Jerry Douglas Leopold, Yukon, OK (US); William Joseph Bickel, Jr., Jones, OK (US)

(73) Assignee: Anti-Pollution Technology, L.P., Frisco, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/110,560

(22) Filed: Aug. 23, 2018

(65) Prior Publication Data

US 2018/0363430 A1 Dec. 20, 2018

Related U.S. Application Data

(63) Continuation of application No. 15/078,773, filed on Mar. 23, 2016, now Pat. No. 10,094,205.

(60) Provisional application No. 62/138,253, filed on Mar. 25, 2015.

(51) Int. Cl.

| | |
|---|---|
| ***E21B 33/08*** | (2006.01) |
| ***E21B 43/12*** | (2006.01) |
| ***G08B 21/18*** | (2006.01) |

(52) U.S. Cl.
CPC ..... *E21B 43/127* (2013.01); *E21B 33/08* (2013.01); *G08B 21/182* (2013.01)

(58) Field of Classification Search
CPC ..... E21B 33/08; E21B 33/085
See application file for complete search history.

(56) References Cited

U.S. PATENT DOCUMENTS

| | | | |
|---|---|---|---|
| 2,096,882 | A | 10/1937 | Chernosky |
| 2,981,557 | A | 4/1961 | Donnell et al. |
| 3,270,810 | A | 9/1966 | Johnston |

(Continued)

FOREIGN PATENT DOCUMENTS

| | | |
|---|---|---|
| WO | 2015003071 | 1/2015 |

OTHER PUBLICATIONS

Stabilizer Bar for Use with a Leak Container for an Oil Well Stuffing Box, Jack Brewer, 1994, 1 page, United States.

(Continued)

*Primary Examiner* — Shane Bomar
(74) *Attorney, Agent, or Firm* — McAfee & Taft

(57) ABSTRACT

A containment apparatus for protecting a surrounding environment from leaks originating from a stuffing box is provided. In some embodiments, the containment apparatus utilizes a float switch to switch off a pump associated with the stuffing box when the level of a liquid in the vessel exceeds a predetermined level. The switch can communicate ultrasonically with a receiver that relays a message to a user. In some embodiments, the vessel comprises two half vessels that are lined by a metal frame along their mating edges.

5 Claims, 10 Drawing Sheets

(56) References Cited

U.S. PATENT DOCUMENTS

| | | | | |
|---|---|---|---|---|
| 4,321,975 | A | 3/1982 | Dyer | |
| 4,665,976 | A | 5/1987 | Retherford | |
| 4,872,508 | A | 10/1989 | Gordon | |
| 5,150,751 | A | 9/1992 | Burton et al. | |
| 5,211,227 | A | 5/1993 | Anderson | |
| 5,246,067 | A | 9/1993 | Heinonen et al. | |
| 5,351,753 | A | 10/1994 | Golson | |
| 5,394,939 | A | 3/1995 | Walker | |
| D365,353 | S | 12/1995 | Brewer | |
| 5,484,024 | A | 1/1996 | Ladd et al. | |
| 5,549,156 | A | 8/1996 | Borden | |
| 5,775,419 | A | 7/1998 | Gramlich | |
| 5,937,947 | A | 8/1999 | Holtby | |
| 6,286,593 | B1 | 9/2001 | Holtby | |
| 6,386,225 | B1 | 5/2002 | Holtby | |
| 8,079,412 | B2 | 12/2011 | Short | |
| 8,127,838 | B2 | 3/2012 | Brewer et al. | |
| 8,342,237 | B1 | 1/2013 | Brewer et al. | |
| 8,365,817 | B2 | 2/2013 | Brewer et al. | |
| 9,605,506 | B1 | 3/2017 | Jameson et al. | |
| 2002/0179300 | A1 | 12/2002 | Gay et al. | |
| 2004/0182567 | A1 | 9/2004 | Matthews | |
| 2011/0232896 | A1 | 9/2011 | Brewer et al. | |
| 2013/0105142 | A1 | 5/2013 | Brewer et al. | |
| 2018/0196097 | A1 * | 7/2018 | Rothbart ..... | G01R 31/02 |

OTHER PUBLICATIONS

Sales Brochure: Pollution Control Corporation, 2000, pp. 1-8, United States.

The Trapper(TM) Installation Information; Pollution Control Corporation, 1997, pp. 1-3, United States.

* cited by examiner

STUFFING BOX LEAK CONTAINMENT APPARATUS

CROSS REFERENCE TO RELATED APPLICATION

This application is a continuation of U.S. application Ser. No. 15/078,773 filed on Mar. 23, 2016, now allowed, and claims the benefit of U.S. Provisional Application 62/138,253 filed on Mar. 25, 2015, which are hereby incorporated by reference.

FIELD OF INVENTION

The present invention relates to an apparatus for containing leaks from a stuffing box at a wellhead as well as methods for using the same.

BACKGROUND

A common problem with wellhead production equipment is that many of the structures associated with a wellhead, such as a stuffing box and polished rod, are susceptible to leaking. As a result, the surrounding environment can be exposed to oil or other fluids which can have deleterious effects on local plants and wildlife. To solve this problem, devices are positioned around portions of the stuffing box and wellhead to contain the leaking material. However, prior containment devices suffer from one or more of the following problems: (1) tedious assembly of the device on the wellhead and tedious removal; (2) disassembly of the device to access the stuffing box; (3) disassembly of the device to visually inspect the stuffing box; (4) lack of a proper liquid seal; and (5) difficulty maintaining the device in a fixed position on the wellhead. As a result of these problems, wellhead operators are more reluctant to utilize containment devices ultimately leading to an increase in pollution.

The present invention seeks to alleviate these problems by providing a containment apparatus that (1) is easily assembled on the wellhead, (2) provides a liquid tight seal around the stuffing box, (3) provides easy access to the stuffing box, and (4) allows for visual inspection or remote inspection of the stuffing box while the apparatus is in place. Such an invention promotes environmentally conscious behavior without the detriment of significant increases in cost and time.

SUMMARY

As known to those skilled in the art, wellhead production equipment typically includes a stuffing box carried on the nipple of a pumping tee. The present invention provides a leak prevention apparatus or containment apparatus suitable for capturing leaks originating at the stuffing box. The apparatus includes a concave tub, a lid and a float switch. The concave tub comprises a wall having a first portion, which extends substantially vertically and terminates at an upper end in an upper rim, and a second portion, which extends substantially horizontally and terminates at an inner end in a lower rim. The wall extends from the upper rim to the lower rim. The lower rim defines a bottom aperture configured to receive a portion of a stuffing box therethrough in a fluid tight seal.

The lid is positioned on the concave tub. The lid is dome-shaped and with an upper opening, which receives a polish rod therethrough in a water resistant seal. The lid also has a bottom rim, which mates with the upper rim of the concave tub.

The float switch is mounted in the first portion of the wall such that the float switch is moved from an on-position to an off-position when a level of liquid in the concave tub exceeds a predetermined level. When moved to the off-position, the float switch wirelessly sends a signal to a monitor.

The containment apparatus can further comprise an ultrasonic receiver configured to receive ultrasonic signals and send electromagnetic signals. The ultrasonic receiver is positioned remotely from the concave tub. When moved to the off-position, the float switch sends an ultrasonic signal to the receiver, and upon detection of the ultrasonic signal, the ultrasonic receiver sends an electromagnetic signal to the monitor.

In another embodiment, there is provided a containment apparatus for protecting the environment from leaks originating from a stuffing box comprising a first half shell, a second half shell, and a lid. When the first half shell and the second half shell are joined together, they form a concave tub having a wall. The wall has a first portion, which extends substantially vertically and terminates at an upper end in an upper rim, and a second portion, which extends substantially horizontally and terminates at an inner end in a lower rim, so that the wall extends from the upper rim to the lower rim. The lower rim defines a bottom aperture configured to receive a portion of a stuffing box therethrough in a fluid tight seal.

The first half shell can be made from metal or plastic and is defined around its periphery by a first portion of the upper rim, a first right edge, a first portion of the lower rim, and a first left edge. The first right edge and the first left edge each extend from the first portion of the upper rim to the first portion of the lower rim. The first right edge, the first portion of the lower rim and the first left edge are formed from a first metal frame attached to the first half shell.

The second half shell can be made from metal or plastic and is defined around its periphery by a second portion of the upper rim, a second right edge, a second portion of the lower rim, and a second left edge. The second right edge and the second left edge each extend from the second portion of the upper rim to the second portion of the lower rim. The second right edge, the second portion of the lower rim and the second left edge are formed from a second metal frame attached to the second half shell. The second half shell is configured to join to the first half shell to form the concave tub; and, when joined, the first right edge mates with the second right edge to create a fluid tight seal, and the first left edge mates with the second left edge to create a fluid tight seal.

The lid is positioned on the concave tub. The lid being dome-shaped and with an upper opening, which receives a polish rod therethrough in a water resistant seal. The lid also has a bottom rim, which mates with the upper rim of the concave tub.

Other embodiments combined the features of the above two embodiments. In some embodiments, when the first half shell and second half shell are joined, a gasket can be positioned between the first half shell and second half shell so as to create the fluid tight seal.

In some embodiments, the first frame comprises a lobe section defining a drain aperture located adjacent to the bottom aperture such that the liquids in the concave tub can be drained from the concave tub. The containment apparatus can further comprise a drain tube having a valve for controlling a flow of the liquids from the concave tub.

In some embodiments, the first metal frame and second metal frame have a pivot-bolt connection. Also, embodiments can further comprise a grease zerk positioned in the wall. The grease zerk can include a hose extending from the grease zerk toward the bottom aperture such that grease can be applied to the portion of the stuffing box without opening the containment apparatus.

Also, some embodiments utilize a lid comprising a first half portion and second half portion. The upper opening can be formed by a split gasket having a first half gasket mounted in the first half portion and a second half gasket mounted in the second half portion. The first half gasket and second half gasket interlock to form a water-resistant seal. The first half portion and the second half portion can each have a ridge adjacent to the upper opening.

In another embodiment, there is provided a method of monitoring a liquid level in a containment vessel comprising;

(a) mounting the containment vessel on a stuffing box such that liquids leaked from the stuffing box collect in the containment vessel;
(b) detecting when the liquid level exceeds a predetermined level; and
(c) sending a signal when the liquid level exceeds the predetermined level, the signal resulting in an electronic message being received by a monitor.

In the method, the signal can be an ultrasonic signal and the method can further comprise:

(d) detecting the signal by an ultrasonic receiver positioned remotely from the stuffing box;
(e) converting the ultrasonic message into the electronic message; and
(f) sending the electronic message to the monitor.

In the method, the ultrasonic receiver can be located from 5 to 200 feet from the stuffing box, 10 to 100 feet from the stuffing box, or can be 15 to 50 feet from the stuffing box. Also, the electronic message can be selected from the group consisting of text messages and email messages. Additionally, the method can further comprise shutting down the well when the liquid level exceeds the predetermined level.

BRIEF DESCRIPTION OF THE DRAWINGS

FIG. 6 is a front view of the containment vessel of FIG. 5.

DETAILED DESCRIPTION

Figure 1B:
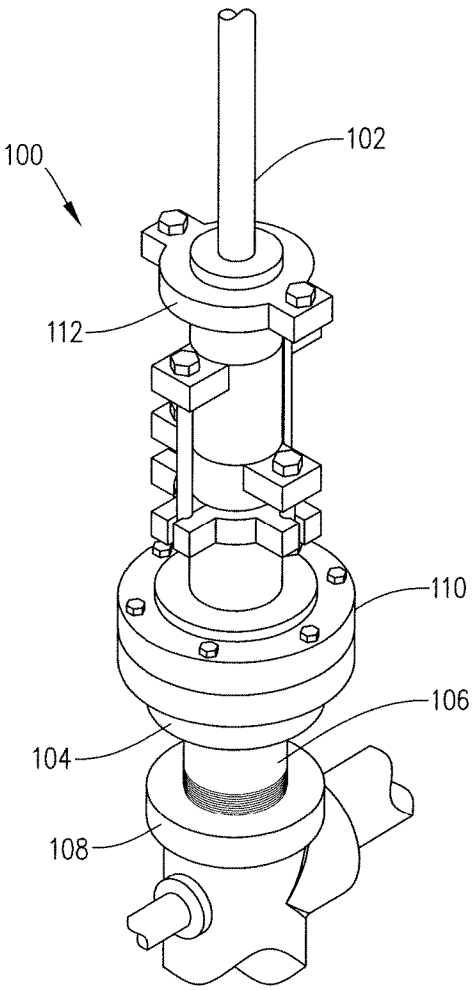
FIG. 1B is a perspective view of a stuffing box assembly on a wellhead.

In the description that follows, like parts are marked throughout the specification and drawings with the same reference numerals, respectively. The drawings are not necessarily to scale and the proportions of certain parts have been exaggerated to better illustrate details and features of the invention. The terms "inwardly" and "outwardly" are directions toward and away from, respectively, the geometric center of a referenced object. Where components of relatively well-known designs are employed, their structure and operation will not be described in detail.

Wellhead production equipment typically includes a stuffing box carried on the nipple of a pumping tee. The present disclosure provides a leak prevention apparatus suitable for capturing leaks originating at the stuffing box. As will be understood upon review of the drawings and description provided herein, the present disclosure describes improved structures and methods for the leak protection apparatus. The present disclosure also describes a method and apparatus for remotely monitoring the liquid levels in the containment apparatus. Additional improvements will be apparent upon review of the appended drawings and written description thereof.

Figure 1A:
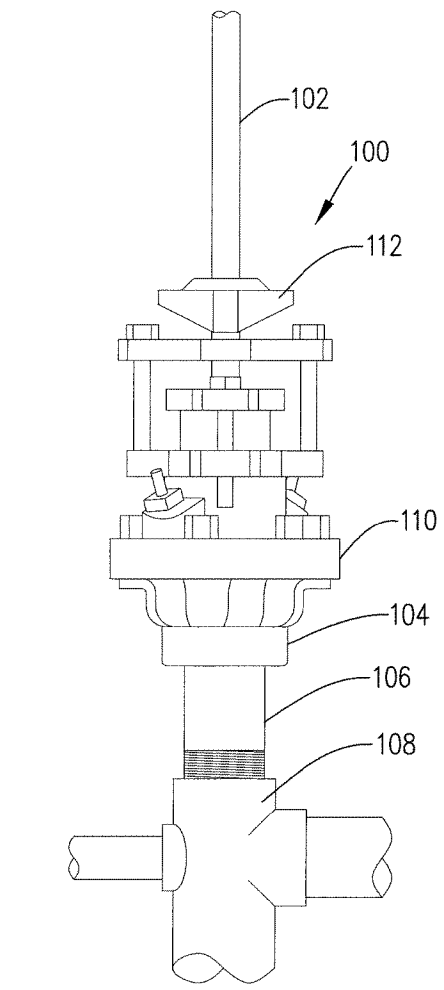
FIG. 1A is a front view of a stuffing box assembly on a wellhead.

To provide a frame of reference for the present invention, FIGS. 1A and 1B depict a typical stuffing box 100 on a wellhead. In relevant part, the stuffing box can comprise a polished rod 102, a stuffing box base 104, a nipple 106, a pumping tee 108, a flange 110 and a lube cap 112. Containment apparatus 200 shown in FIGS. 2A and 2B is suitable for mounting at various places on stuffing box 100, including at flange 110 and at nipple 106.

Figure 2A:
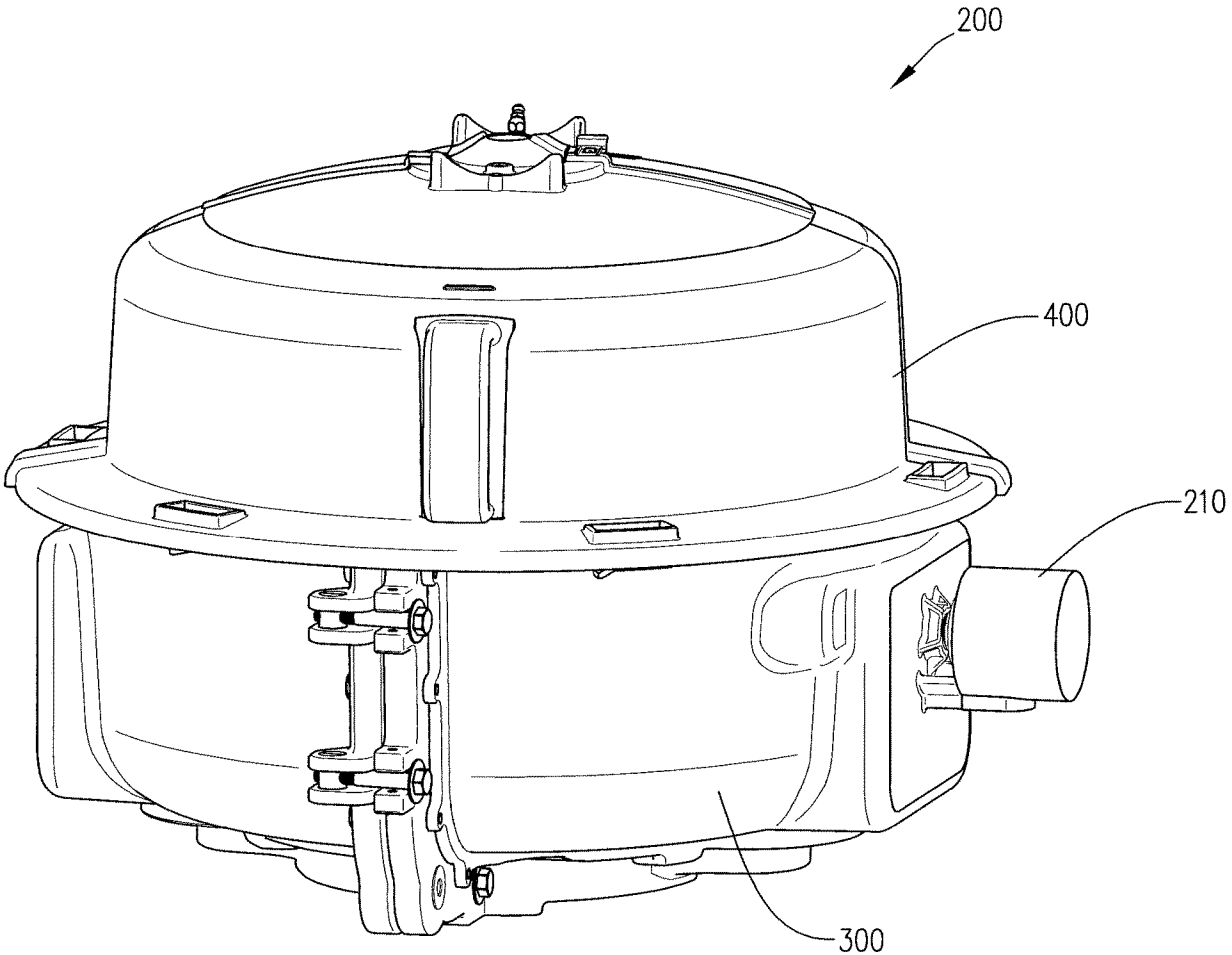
FIG. 2A is a side perspective view of a containment apparatus with a lid in accordance with one embodiment.

Turning now to FIGS. 2A and 2B, containment apparatus 200 of the present invention can be divided into essentially three primary components: (1) a containment vessel or tub 300; (2) a topper or lid 400; and (3) a liquid level monitoring system, which generally comprises at least a float switch 210.

As depicted in the figures and as best seen from FIGS. 3-5 and 10, a float switch 210 is mounted in the wall 302 of the tub 300. The float switch has a float arm 212 within tub 300 that is moved by rising liquid levels in the tub from an on-position to an off-position. Generally, float switch 210 is connected to the well pump 214 (FIG. 10) so as to be able to turn on or off the well pump based on the liquid levels within tub 300. The connection can be a hardwire connection, wireless connection, pneumatic connection, or similar. That is, when float switch 210 is in its on-position, pump 214 can operate but, when float switch 210 is in its off position, pump 214 is prevented from operating.

In some embodiments, housing 208 of float switch 210 contains a transmitter and a battery to supply power to the transmitter. The transmitter is configured to send a signal when the float switch moves to the off position. Additionally, housing 208 of float switch 210 will be sealed so as not to let liquids and/or gasses penetrate into the housing area where the transmitter and battery are located.

In other embodiments, the transmitter can be wired into the pumping unit or well pump 214. The transmitter is configured to send a signal when the float switch turns off the pump.

In either embodiment, the transmitter can be configured to send any suitable signal such as an electromagnetic signal or an ultrasonic signal. The electromagnetic signal can send a message directly through a cellular network to a person monitoring the well operation, such as the operator of the well. Hereinafter, such a person is generally referred to as a monitor.

Preferably, the transmitter is an ultrasonic transmitter, which sends out an ultrasonic signal. Such an ultrasonic signal reduces the need for antennas and reduces risk in the hazardous area around the stuffing box, which can sometimes be a class 1, division 1 hazardous zone. In such hazardous zones, electrical components exposed to gasses present in the hazardous zone create a risk of fire or explosion. If an ultrasonic transmitter is used, then an ultrasonic receiver 216 (FIG. 10) is typically used within range of the ultrasonic transmitter. Ultrasonic receiver 216 typically will be configured to transmit a signal over a cellular or satellite network. Thus, by using ultrasonic receiver 216, antennas and other electrical components associated with sending an electromagnetic signal can be placed outside of any hazardous zone and, hence, reduce the risk of igniting flammable gases within the zone. For example, the ultrasonic receiver can be located from 5 to 200 feet from the stuffing box, 10 to 100 feet from the stuffing box, or can be 15 to 50 feet from the stuffing box.

In operation, when little or no liquid is present in tub 300, float arm 212 is in a lower position and float switch 210 is in its on-position such that well pump 214 can be run. Typically, in the on-position no signal is sent from float switch 210. If the stuffing box is leaking, then liquid will collect in tub 300. Eventually, the rising liquid levels in tub 300 will move float arm 212 from its lower position to a higher position such that float switch 210 is moved to its off-position. In the off-position, float switch 210 prevents well pump 214 from running thereby reducing or stopping leakage into tub 300 before the liquid capacity of tub 300 is exceeded. Also, in the off-position, the transmitter sends out a signal.

If the signal is an electromagnetic signal, then float switch 210 sends a signal through a cellular network or satellite network to the monitor. The signal can be an electronic message, such as a text message, email message, pager message or similar, which the monitor can receive on a computer, smart phone or similar. In some embodiments, the electronic message can be sent to a website through a cellular network or through a satellite. The website receiving the message can then send out an email or text message to addresses that are listed on the account. Often there will be several pumps on the same system; that is, that send signals to the same web site or to the same monitor of the wells. In such cases, the signal can contain a unique identifier such that the containment apparatus associated with the ultrasonic signal can be identified. For example, the electronic message can contain GPS information on the well's location or other information to identify the well or containment apparatus, such as a unique ID number.

More typically, the signal will be an ultrasonic signal. A receiver positioned outside the hazardous zone receives the ultrasonic signal and in response sends out an electromagnetic signal, typically over a cellular network. The signal can be an electronic message, such as a text message, email message, pager message or similar, which the monitor can receive on a computer, smart phone or similar. In some embodiments, the electronic message can be sent to a website through a cellular network or through a satellite. The website receiving the message can then send out an email or text message to addresses that are listed on the account.

Often there will be several pumps within ultrasonic transmission of the receiver. Each of the pumps can have a containment apparatus associated with its stuffing box. In such cases, the ultrasonic signal can contain a unique identifier such that the containment apparatus associated with the ultrasonic signal can be identified. The receiver in response to the ultrasonic signal then sends out an electronic message that identifies the containment apparatus. For example, the electronic message can contain GPS information on the well's location or other information to identify the well or containment apparatus, such as a unique ID number.

The monitor of the well, such as the well owner or operator, receives the electronic message. The message typically shows the identification information for the well and that the well has been shut down. Because the message contains information to identify the well or containment apparatus, the monitor will know which well needs attention.

Turning now to FIGS. 5-9, an improved version of the containment apparatus 200 is illustrated. The containment device has some common features with the device disclosed in co-pending application U.S. patent application Ser. No. 14/322,766, filed Jul. 2, 2014, and can be used either directly on a flange 110 or nipple 106 of the stuffing box 100 or can be used with an adapter ring as described in the previously mentioned patent documents.

As best seen from FIGS. 5-8, tub 300 is a concave tub having a wall 302. Wall 302 comprises a first portion 304, which extends substantially vertically and terminates at an upper end 306 in an upper rim 308, and a second portion 310, which extends substantially horizontally and terminates at an inner end 312 in a lower rim 314. Typically, first portion 304 and second portion 310 are connected by arcuate portion 316. While described as separate portions, generally first portion 304, second portion 310 and arcuate portion 316 are integral so as to form a seamless wall 302 extending from upper rim 308 to lower rim 314. Upper rim 308 is configured to attach to lid 400. Lower rim 314 defines a bottom aperture 318 and is configured to receive a portion of a stuffing box therethrough in a fluid tight seal, either directly or with the use of an adapter. The fluid tight connection with a stuffing box is further described in U.S. patent application Ser. No. 14/322,766.

Tub 300 is composed of a first half shell 320 and a second half shell 340, which when joined together form concave tub 300. In describing tub 300 and its half shells the terms "left" and "right" are utilized to distinguish one side of tub 300 from the other side. For purposes of this description, the terms left and right are in relation to view looking towards face plate 301 in FIG. 6. It will be understood that the use of the terms "left" and "right" is for explanation purposes only and to ease understanding.

Figure 7:
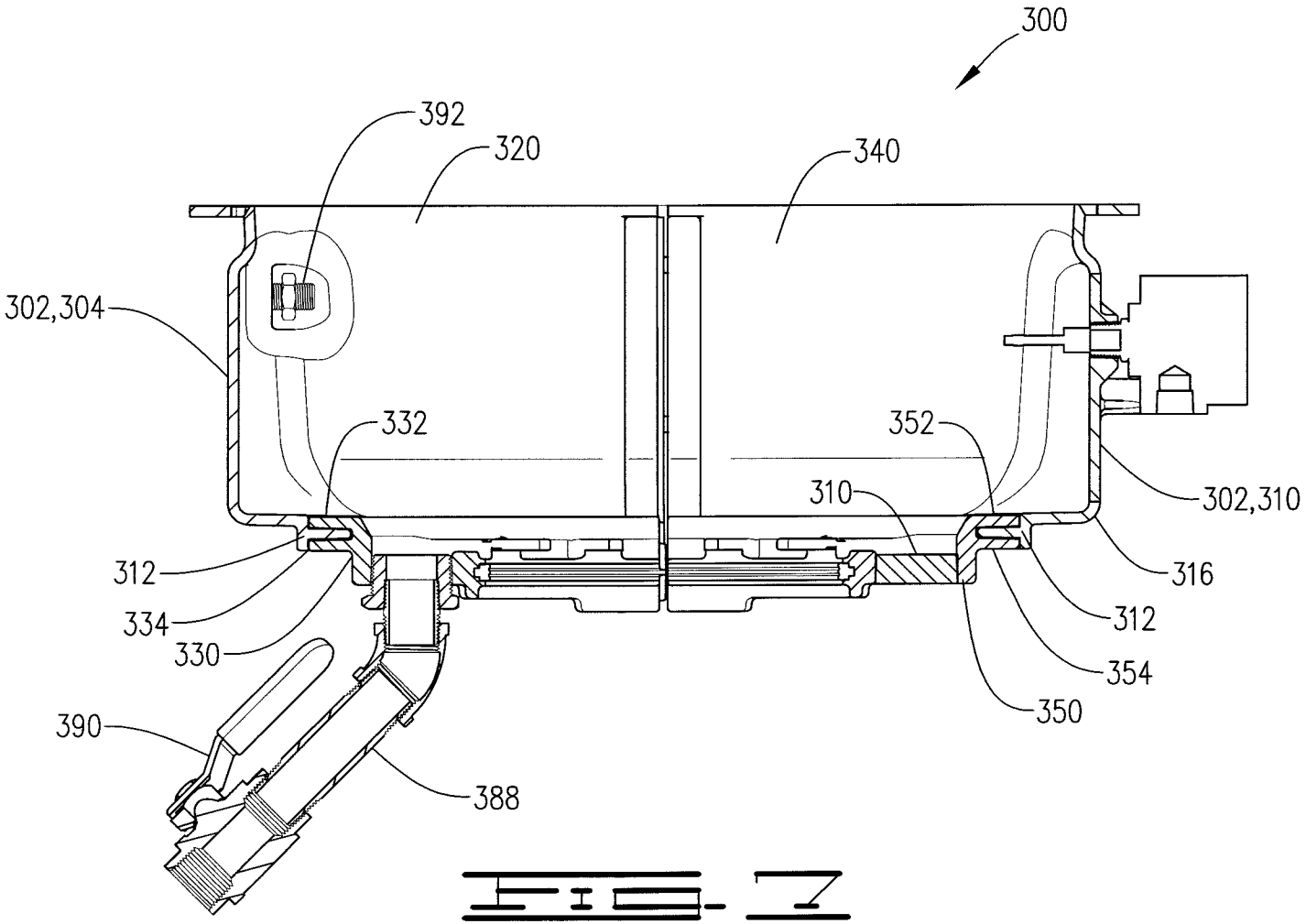
FIG. 7 is a sectional view of the containment vessel of FIG. 5.

First half shell 320 is made from plastic or a metal, such as aluminum, and is defined around its periphery by a first portion 322 of upper rim 308, a first right edge 324, a first portion 326 of lower rim 314, and a first left edge 328. First right edge 324 and first left edge 328 each extend from first portion 322 of upper rim 308 to first portion 326 of lower rim 314. Further, first right edge 324, first portion 326 of lower rim 314 and first left edge 328 are formed from a first metal frame 330 attached to first half shell 320. As best seen in FIG. 7, inner end 312 of wall 302 interlocks into first metal frame 330 such that it is sandwiched between an upper frame member 332 and a lower frame member 334. The interlock provides strength and guards against leaks by forming a fluid tight seal. Further, first half shell 320 can be attached to first metal frame 330 by glue and/or bolts 331, see FIG. 6.

Similar to first half shell 320, second half shell 340 is made from plastic or a metal, such as aluminum, and is defined around its periphery by a second portion 342 of upper rim 308, a second right edge 344, a second portion 346 of lower rim 314, and a second left edge 348. Second right edge 344 and second left edge 348 each extend from second portion 342 of upper rim 308 to second portion 346 of lower rim 314. Further, second right edge 344, second portion 346 of lower rim 314 and second left edge 348 are formed from a second metal frame 350 attached to second half shell 340. As best seen in FIG. 7, inner end 312 of wall 302 interlocks into second metal frame 350 such that it is sandwiched between an upper frame member 352 and a lower frame member 354. The interlock provides strength and guards against leaks by forming a fluid tight seal. Further, second half shell 340 can be attached to second metal frame 350 by glue and/or bolts.

First half shell 320 and second half shell 340 are configured to join to form tub 300. When joined, first right edge 324 mates with second right edge 344 to form a first mating pair of frame edges. The first mating pair creates a fluid tight seal. Typically, at least one of first right edge 324 and second right edge 344 has a channel 362. A gasket 364 is positioned in channel 362, which allows gasket 364 to deform into channel 362 reducing the clamping pressure while still providing positive pressure on the gasket seal. Similarly, when joined, first left edge 328 mates with second left edge 348 to form a second mating pair of frame edges. The second mating pair creates a fluid tight seal. At least one of first left edge 328 and second left edge 348 have a channel 372 with a gasket 374 positioned therein, which allows gasket 374 to deform into channel 372 reducing the clamping pressure while still providing positive pressure on the gasket seal.

First half shell 320 and second half shell 340 can each be connected by pivot-bolt connections or swing-bolt connections. A suitable swing-bolt connection can be best seen from FIGS. 5 and 8 where swing bolts 376 attached to second left edge 348 and first right edge 324 with a barrel nut 378 mounted in lobes 380 on frames 330 and 350, respectively. The barrel nut attachment allows swing bolt 376 to pivot about. When swing bolt 376 is pivoted into place on the first left edge 328 or second right edge 344, it can be held in place by a roll pin 382. Thus, when only one side of tub 300 has its swing-bolt held in place with roll pin 382, the first half shell 320 and second half shell 340 can pivot about the swing-bolt connection to allow opening and closing of the two half shells without totally disconnecting them. Accordingly, tub 300 can be easily mounted on a stuffing box by hinging tub 300 open and closing it when tub 300 is correctly positioned. Upon positioning tub 300, the swing bolts 376 on each side can be tightened to clamp together first half shell 320 and second half shell 340 in a liquid tight seal. This hinge and clamping system allows the two half shells to be parallel when being clamped together for better alignment and to eliminate gasket pinch on the hinge side. Additionally, it is desirable that gaskets 364 and 374 be sized so that the gaskets come into contact with both frames and forms a liquid tight seal before the frames are completely clamped together; i.e. touching. This allows the two half shells to be fitted on a larger range of stuffing boxes because the halves do not need to be completely closed in order to seal.

Figure 8:
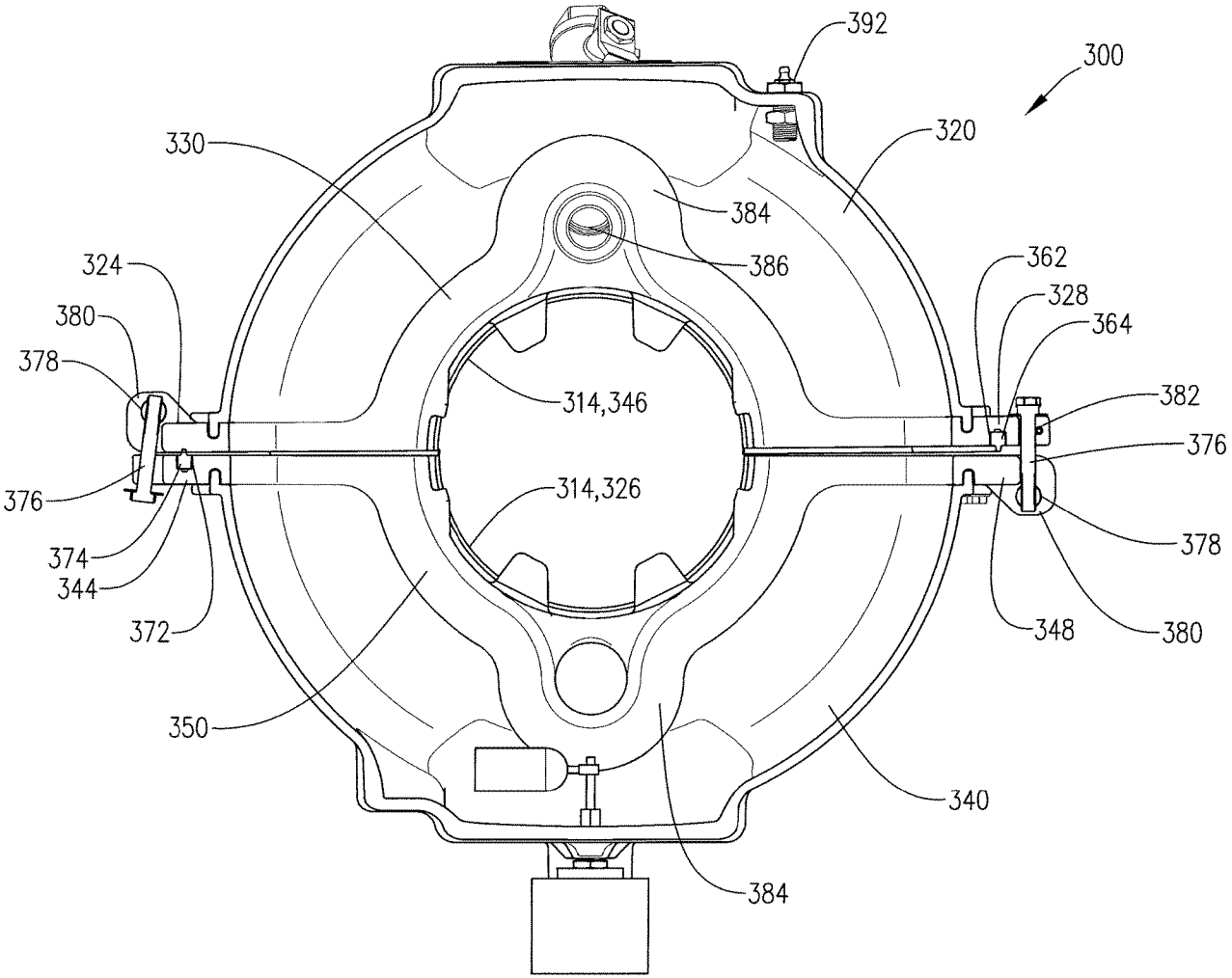
FIG. 8 is a top view of the containment vessel of FIG. 5.

In some embodiments, first metal frame 330 and second metal frame 350 extend circumferentially around bottom aperture 318 as illustrated in FIG. 8 and can have lobe sections 384 extending radially outward from bottom aperture 318. At least one of lobe sections 384 can define a drain aperture 386. As can be seen from FIGS. 5-7, drain aperture 386 can be connected to a drain tube 388 having a valve 390 for controlling the flow of liquids from tub 300. Accordingly, bottom aperture 318 allows liquids in tub 300 to be drained from tub 300. When tub 300 is made of plastic, the metal frame provides a stronger connection for drain tube 388 than the plastic portion of tub 300, thus aperture 386 is less prone to deforming or cracking that could cause leaks and/or drain tube 388 to pull out from aperture 386.

In some embodiments, tub 300 includes a grease zerk 392 positioned in wall 302 such that grease can be applied to a portion of the stuffing box without opening the containment apparatus. Grease zerk 392 can include a hose (not shown) extending from grease zerk 392 toward bottom aperture 318.

Figure 2:
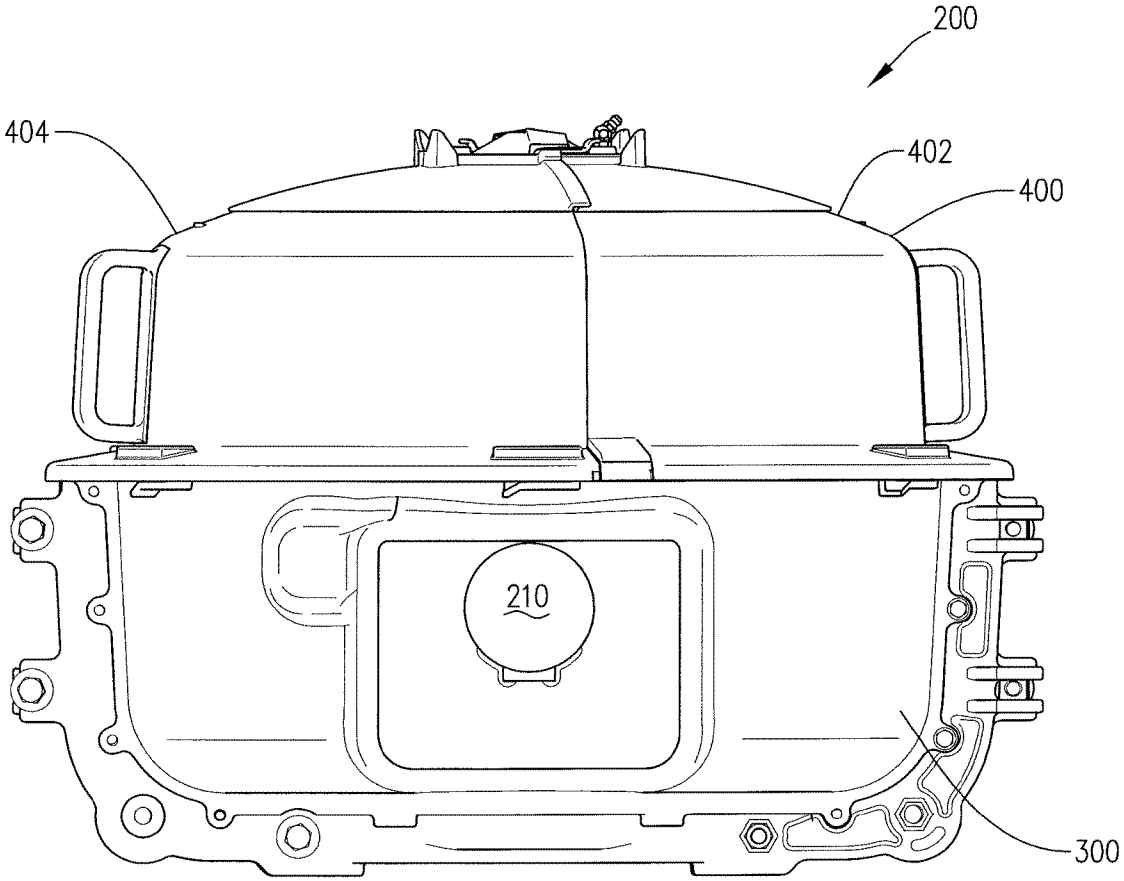
FIG. 2B is a rear perspective view of the containment apparatus of FIG. 2A.
Figure 3:
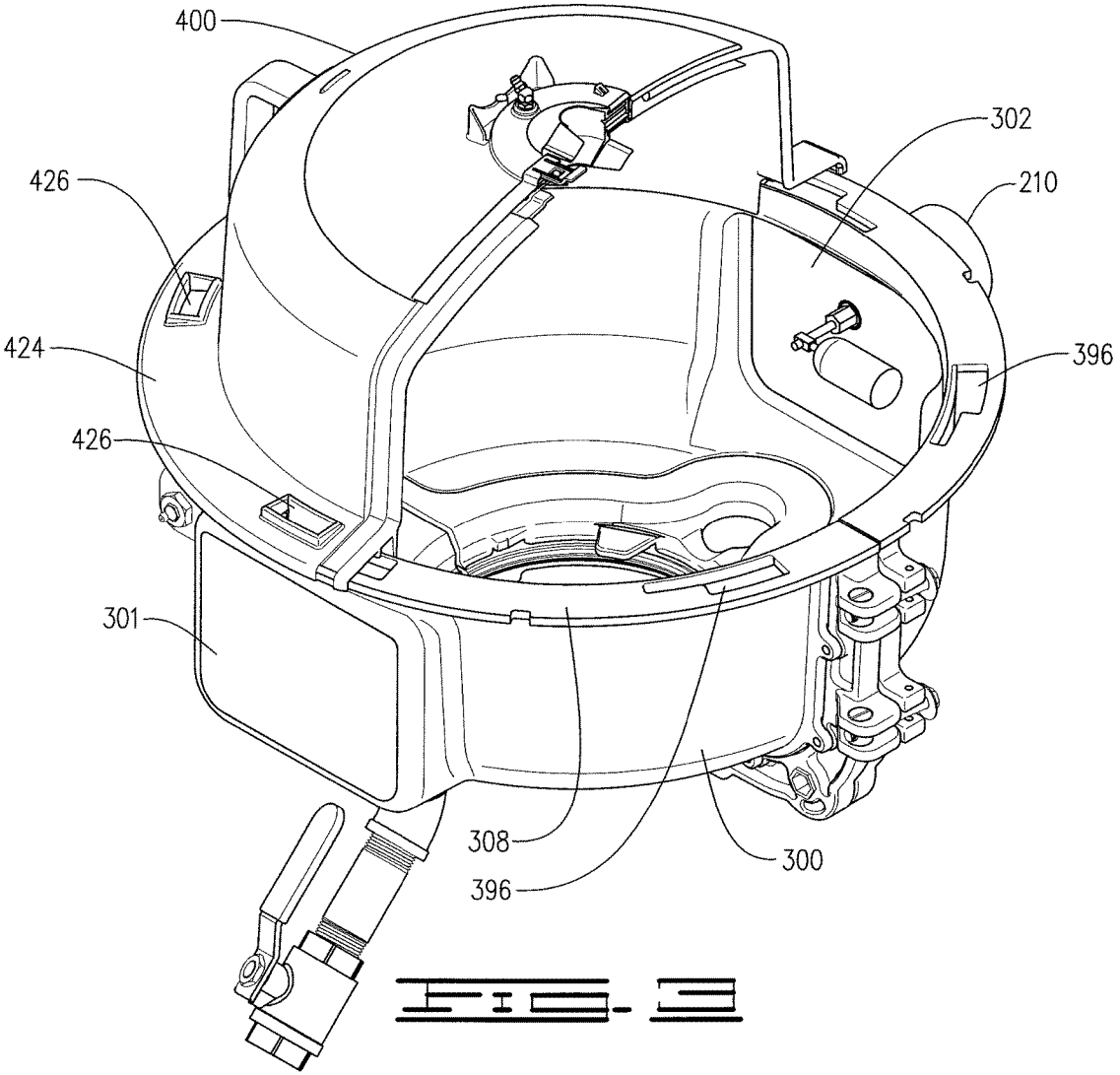
FIG. 3 is a perspective view of a containment apparatus with a partial lid shown.
Figure 5:
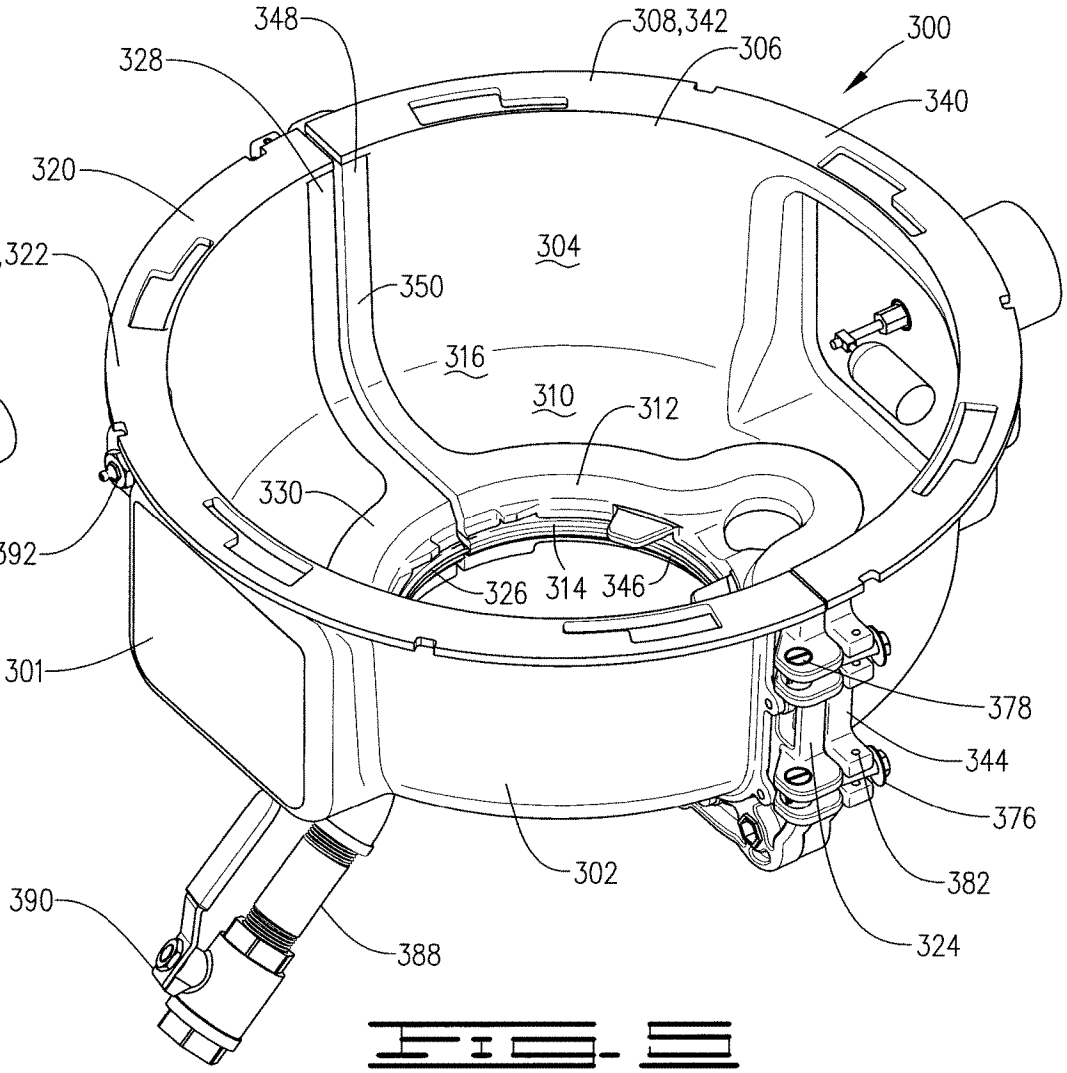
FIG. 5 is a containment vessel having a metal frame in accordance with one embodiment.
Figure 4:
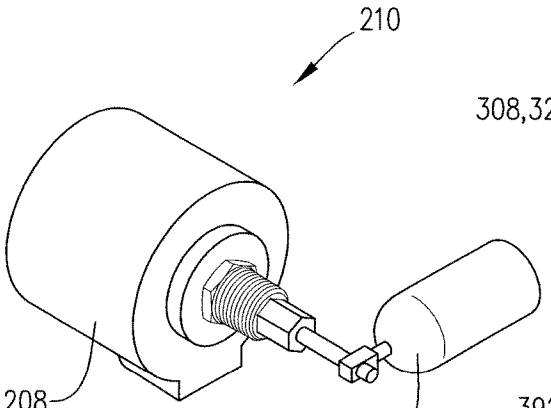
FIG. 4 is a perspective view of a float switch in accordance with one embodiment of the invention.
Figure 3:
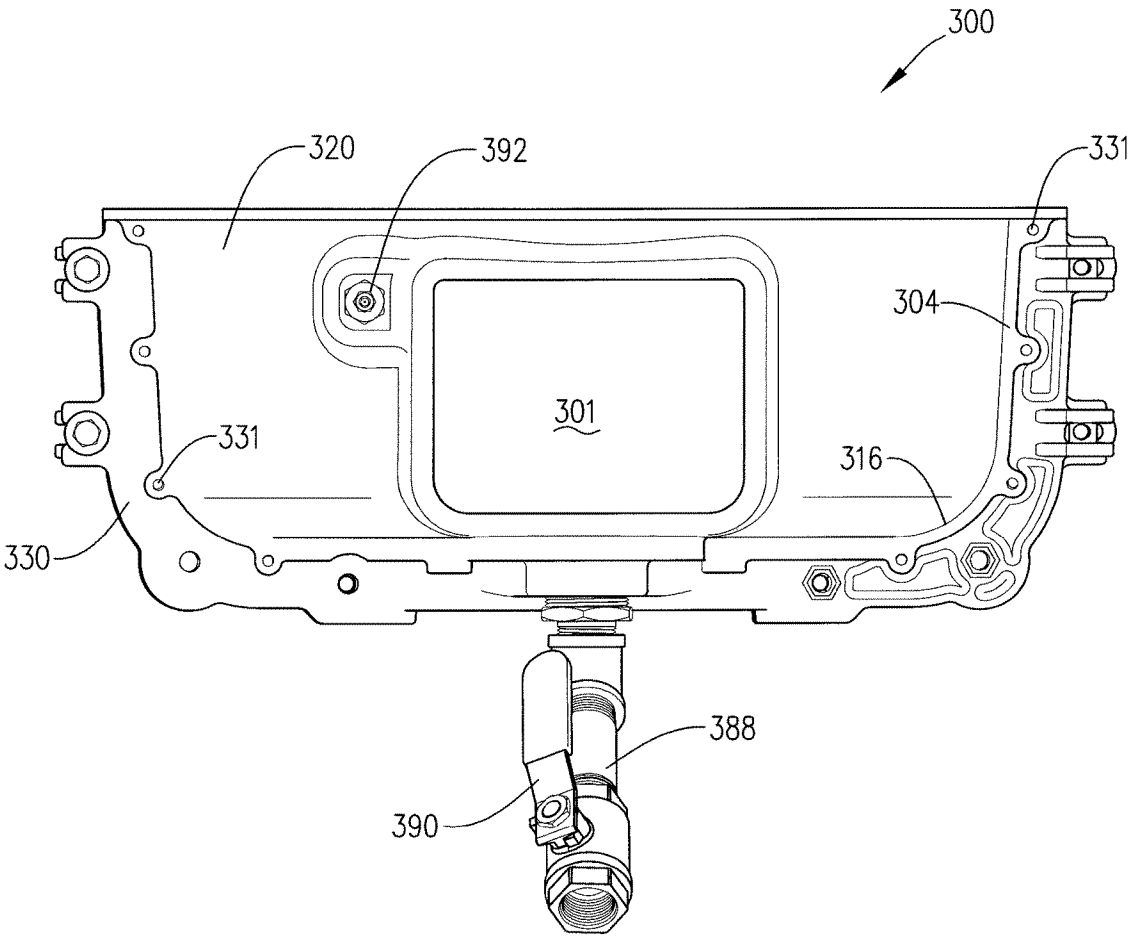
Figure 9:
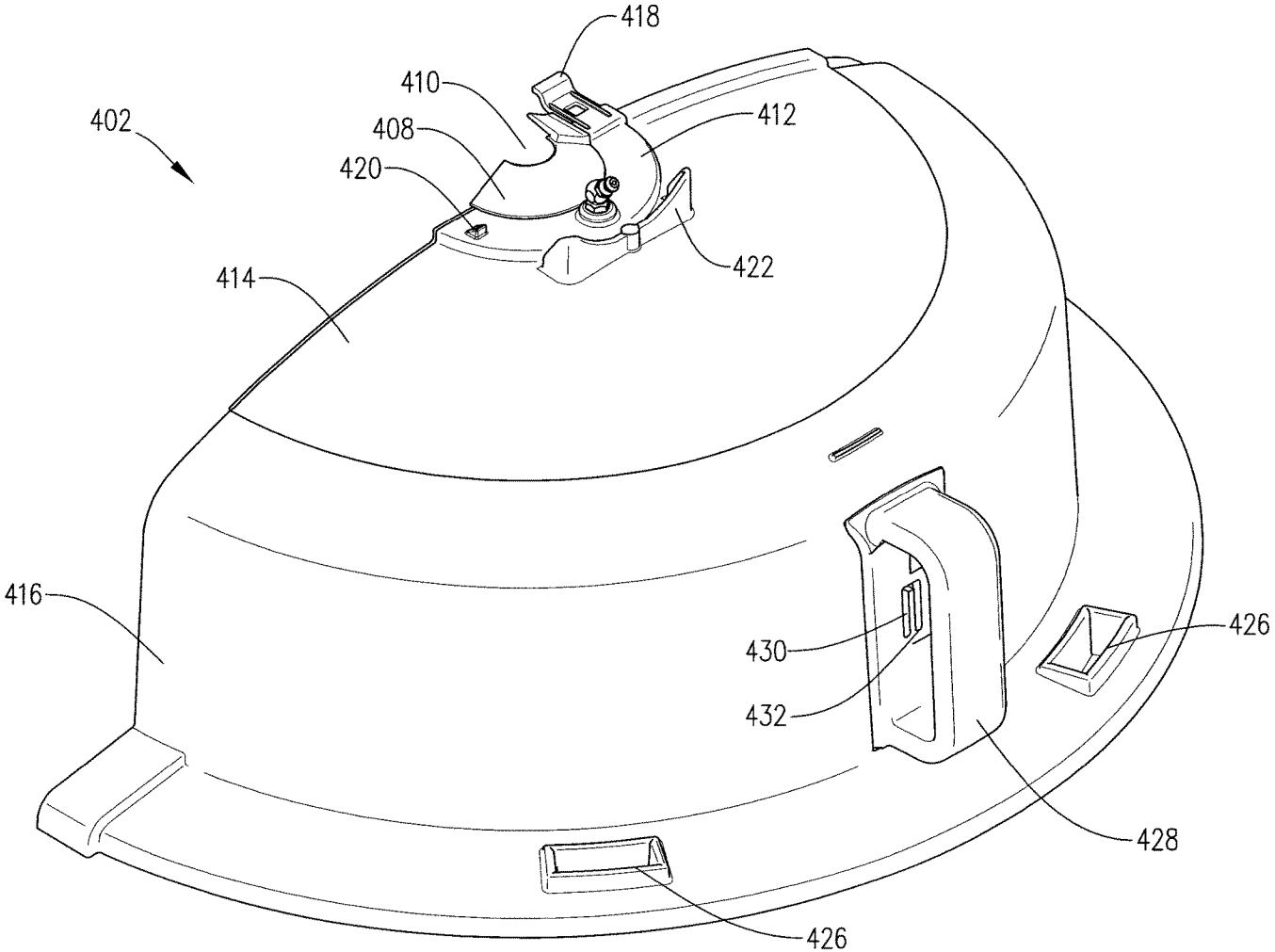
FIG. 9 is a perspective view of a first half portion of a lid for a containment vessel.
Figure 10:
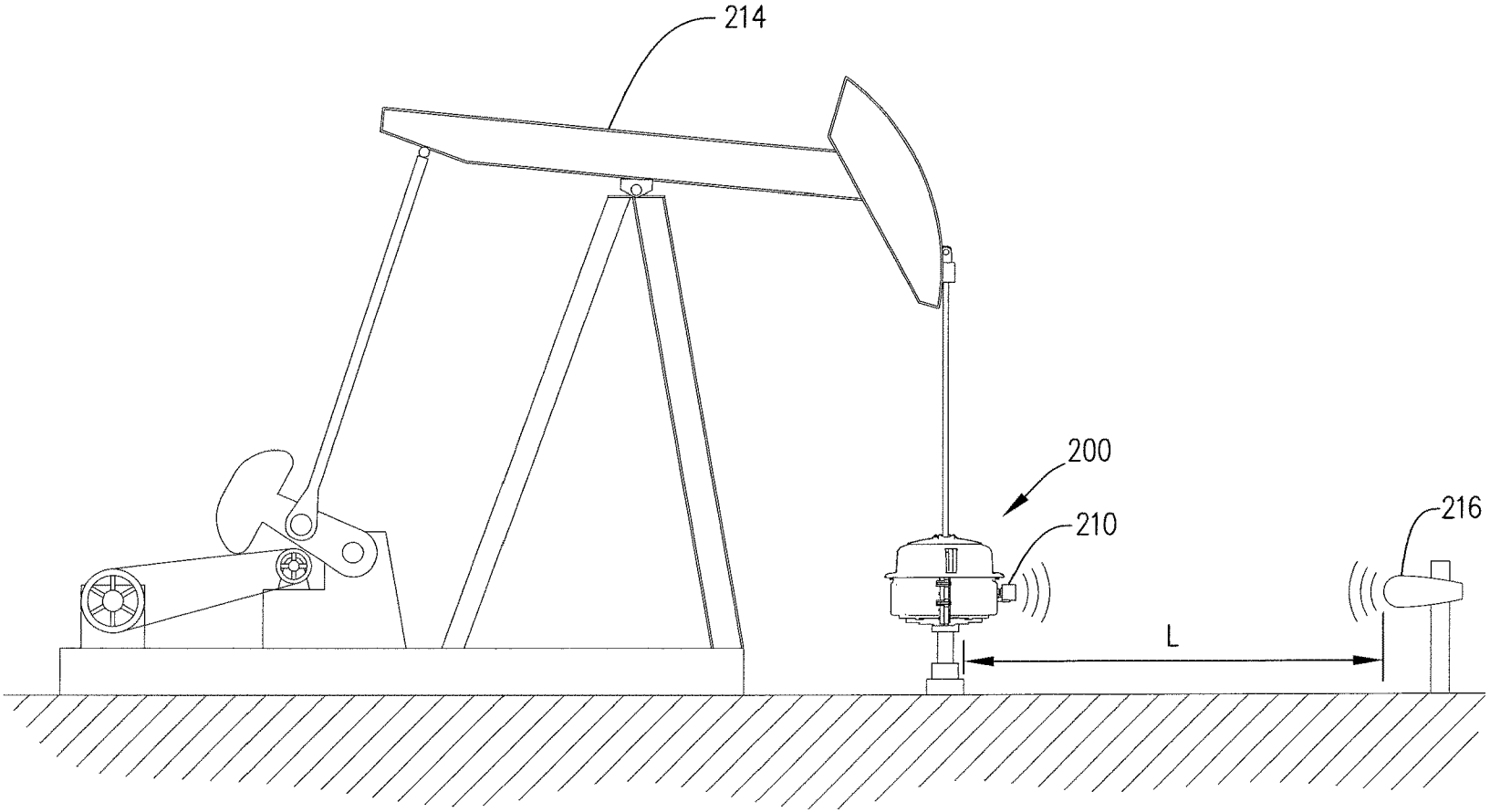
FIG. 10 is a schematic representation of a well having a pump and a stuffing box utilizing a containment apparatus in accordance with one embodiment.

With reference to FIGS. 2, 3 and 9, the topper or lid 400 will now be described. As can be seen from FIG. 2, lid 400 comprises a first half lid 402 and a second half lid 404, which together form dome-shaped lid 400. Both half lids are identical. FIG. 9 shows first half lid 402 but the following description applies to second half lid 404. First half lid 402 has an upper opening with a half gasket 408 such that when first half lid 402 and second half lid 404 are fastened together the two half gaskets 408 form a complete gasket defining a center aperture 410. Thus, the complete gasket has a bulging disk shape with a hole in the center. A polish rod can be received through center aperture 410 such that gasket 408 forms a water-resistant seal with the polished rod. Half gasket 408 is partially contained in an upper rim 412 of half panel 414 so as to retain half gasket 408 in place.

A half panel 414 floatingly interacts with upper lid base 416 such that it can slide relative to lid base 416 to accommodate polish rods that might be askew, at an angle, or off center from the containment apparatus. Thus, half panel 414 can slide laterally with respect to lid base 416 but is still confined so as not to slide out of relationship with lid base 416. The half panels of first half lid 402 and second half lid 404 attach together by means of a clip 418 and tab 420 with clip 418 of one of the half panels securing over tab 420 of the other half panel. Typically, clip 418 and tab 420 will be formed on upper rim 412. Also, ridge 422 can be formed on half panel 414 on or adjacent to upper rim 412. Ridge 422 provides for a place to push when connecting two half panels together.

As can best be seen from FIG. 3, bottom rim 424 of lid 400 mates with upper rim 308 of tub 300. Lid 400 can be attached to containment vessel 300 in a number of different manners, which will be apparent to those skilled in the art. Preferably, bottom rim 424 carries one or more downwardly projecting tabs 426. (Only the upper surface of tabs 426 is visible in FIGS. 3 and 9.) Downwardly projecting tabs 426 are configured to be received by one or more bayonet mount receiving slots 396 spaced accordingly on an upper rim 308 of the containment vessel 300 (see FIG. 3). Bottom rim 424 of lid 400 is placed on upper rim 308 of tub 300 such that downwardly projecting tabs 426 are aligned with the bayonet mount receiving slots 396. The lid 400 is locked in place by turning it clockwise to move tabs 426 into the proper position with the bayonet mount receiving slots 396. Lid base 416 can have handgrips 428 to facilitate turning of lid 400. Handgrips 428 can be "snap-on" handles that attach by pushing so that slots 430 and clips 432 engage in locking relation. Slots 430 can be either on the handles or the lid base with the other having clips 432.

The tub can be manufactured from metal, such as aluminum, or from any thermoplastic or thermosetting plastic material suitable for injection molding including, but not limited to polyurethane, polyamide, polyethylene, polypropylene, polystyrene, acrylonitrile butadiene styrene or polyvinyl chloride. The thermoplastic or thermosetting plastic can optionally include glass or carbon fibers. Polyethylene is currently preferred for use for the tub when the application will be at temperatures at or below about 120° F. Metal or a glass-filled polyamide, such as Nylon, is currently preferred for use for the tub when the application will be at temperatures above 120° F.

It is currently preferred that the frame be manufactured from a metal, such as aluminum for strength and corrosion resistance.

The lid can be manufactured using any durable plastic material. Transparent polycarbonate is currently preferred.

The gaskets can be formed from a rubber or a rubber like elastomer. Currently, polyurethane or a fluoropolymer elastomer is preferred, such as Viton™ synthetic rubber by DuPont Performance Elastomers L.L.C. Vitona.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A containment apparatus for protecting a surrounding environment from leaks originating from a stuffing box comprising:

a first half shell and a second half shell, which when joined together form a concave tub having:

a wall having a first portion, which extends substantially vertically and terminates at an upper end in an upper rim, and a second portion, which extends substantially horizontally and terminates at an inner end in a lower rim, so that said wall extends from said upper rim to said lower rim, and wherein said lower rim defines a bottom aperture configured to receive a portion of a stuffing box therethrough in a fluid tight seal; and wherein:

said first half shell is defined around its periphery by a first portion of said upper rim, a first right edge, a first portion of said lower rim, and a first left edge, with said first right edge and said first left edge each extending from said first portion of said upper rim to said first portion of said lower rim, wherein said first right edge, said first portion of said lower rim and said first left edge are formed from a first metal frame attached to said first half shell; and said second half shell defined around its periphery by a second portion of said upper rim, a second right edge, a second portion of said lower rim, and a second left edge, with said second right edge and said second left edge each extending from said second portion of said upper rim to said second portion of said lower rim, wherein said second right edge, said second portion of said lower rim and said second left edge are formed from a second metal frame attached to said second half shell, and wherein said second half shell is configured to join to said first half shell to form said concave tub; and, when joined, said first right edge mates with said second right edge to create a fluid tight seal, and said first left edge mates with said second left edge to create a fluid tight seal; and a lid positioned on said concave tub; said lid being dome shaped and with an upper opening, which receives a polish rod therethrough in a water resistant seal, and a bottom rim, which mates with said upper rim of said concave tub.

2. The containment apparatus of claim 1, wherein said first half shell and second half shell are made from metal.

3. The containment apparatus of claim 1, further comprising:

float switch mounted in said first portion of said wall such that said float switch is moved from an on-position to an off-position when a level of a liquid in said concave tub exceeds a predetermined level and wherein, when moved to said off-position, said float switch wirelessly sends a signal to a monitor.

4. The containment apparatus of claim 1, wherein, when said first half shell and second half shell are joined, a gasket is positioned between said first half shell and second half shell so as to create said fluid tight seal.

5. The containment apparatus of claim 4, wherein said first half shell and second half shell are made from metal and further comprising:

float switch mounted in said first portion of said wall such that said float switch is moved from an on-position to an off-position when a level of a liquid in said concave tub exceeds a predetermined level and wherein, when moved to said off-position, said float switch wirelessly sends a signal to a monitor.

* * * * *